United States Patent [19]

Schär

[11] 4,340,101

[45] Jul. 20, 1982

[54] NAILING TOOL

[76] Inventor: Anton Schär, Schönenbergstrasse 42, CH-8820 Wädenswil, Switzerland

[21] Appl. No.: 195,141

[22] PCT Filed: Sep. 6, 1979

[86] PCT No.: PCT/CH79/00120

§ 371 Date: May 8, 1980

§ 102(e) Date: May 2, 1980

[87] PCT Pub. No.: WO80/00547

PCT Pub. Date: Apr. 3, 1980

[30] Foreign Application Priority Data

Sep. 8, 1978 [CH] Switzerland ..... 9450/78

[51] Int. Cl.[3] ..... B25C 1/00

[52] U.S. Cl. ..... 145/30 R

[58] Field of Search ..... 145/30 R, 30 A

[56] References Cited

U.S. PATENT DOCUMENTS

| | | | |
|---|---|---|---|
| 736,465 | 8/1903 | Vogue | 145/30 R |
| 864,733 | 8/1907 | Hamilton | 145/30 R |
| 1,001,261 | 8/1911 | Forth | 145/30 R |
| 1,135,784 | 4/1915 | Faulkner | 145/30 R |
| 1,163,409 | 12/1915 | Jacoby | 145/30 R |
| 1,609,592 | 12/1926 | Williams | 145/30 R |
| 1,678,680 | 7/1928 | Patton | 145/30 R |
| 2,816,289 | 12/1957 | Moinichen | 145/30 R |

*Primary Examiner*—James L. Jones, Jr.

*Attorney, Agent, or Firm*—Pollock, VandeSande & Priddy

[57] ABSTRACT

A nailing tool in the form of a hammer is provided to enable a number of nails to be knocked successively into workpieces by single-handed operation. The tool comprises a cavity in the handle of the hammer forming the nail magazine, followed by a passage in the handle leading to a curved deflector within the handle which feeds one nail at a time to the hammer head (20). At the hammer head the nail ($N_1$) is held by a permanent magnet adjacent an auxiliary striking surface that is spaced from the main striking surface of the hammer head, for setting into the workpiece. To ensure that only one nail reaches the deflector at any time, the passage contains a nail retainer which passes only one nail at a time when actuated manually.

7 Claims, 5 Drawing Figures

NAILING TOOL

This invention relates to a nailing tool in the form of a hammer. The knocking in of a nail is occasionally complicated, particularly when the right hand holds the hammer while the left hand is holding the component requiring to be fixed, and then a nail has to be set into position. A considerable amount of skill is required for overhead nailing for vertical or horizontal fixing.

Swiss Pat. No. 267 760 attempts to remedy this difficulty. It proposes forming the hammer head with a recess into which a nail can be inserted and is retained by means of a magnet. This allows the nail to be set into position if careful handling is applied, but the disadvantage of such a system is that the nail head has only little support, because its bearing surface is too small and both hands are again required for inserting a nail into the recess.

The object of this invention is to provide a nailing tool which, with single-handed operation, allows a number of nails to be successively set into position and knocked home quickly and reliably.

To this end, the invention provides a nailing tool in the form of a hammer, which is characterized in that its handle contains a magazine for nails, said magazine communicating with a passage leading to a deflector means, the latter being connected, at the hammer head, to a catcher means, the passage containing a nail retainer while a permanent magent is provided near the hammer head and the catcher, together with a stop which is set back from the striking surface of the hammer head, said stop being situated above the nail that has passed through.

One exemplified embodiment of the subject matter of the invention is illustrated in the drawing and its use is explained hereinafter.

FIG. 1 is a longitudinal section of a nailing tool.

FIG. 1*a* shows the nail retainer in side elevation to an enlarged scale.

FIGS. 2 to 4 show the tool in use.

The drawing shows the handle in section. It could be constructed, for example, from two symmetrical halves. The handle has been given the general reference 10. The rear part of the handle contains a cavity 11 which forms the magazine for the nails N. At its rear end the cavity 11 is closed by a removable plug 12. At its front end extending towards the hammer head 20, the cavity 11 merges into a passage 13 leading into a deflector 14. While the passage 13 has a circular cross-section of a size such that it allows the nail head to pass with clearance, the deflector 14 is a flat curved cavity, the width of which is equivalent to the diameter of the passage 13, and is open at the front. Reference 15 denotes a fork mounted at the front open end of the curved deflector 14 while 16 denotes a nose or auxiliary striking surface produced by reducing the diameter of the deflector cavity. As shown in FIG. 1, the nose 16 is located below and rearward of, and extends generally parallel to, the striking face 20' of hammer head 20.

If the tool is held with the hammer head 20 extending obliquely downwards as shown in FIG. 2, a nail N, that is located in the deflector 14 falls toward the hammer head under the influence of gravity and, in doing so, is pivoted clockwise about its longitudinal axis through about 45°. When the nail, so pivoted, reaches the open front end of deflector 14, the nail then drops, point first, into the fork 15, which retains the nail at its head so that it does not drop out of the deflector 14. A permanent magnet 21 recessed into the hammer head 20 adjacent and at a distance from the fork 15 then pulls the nail $N_1$ laterally out of the fork 15 towards the said magnet and it continues to be held only by the magnet 21. The nose 16 , forming an interior striking head that is disposed adjacent the head of the nail $N_1$ held by magnet 21, is then used to set this nail $N_1$ into the workpiece 37, into which it is shallowly driven. The auxiliary striking surface or nose 16 is an integral part of the handle 10 (FIG. 1) but could alternatively be formed by a shoulder on the hammer head 20.

To ensure that only a single nail passes to the deflector 14 at the required time during use, a nail retainer 30 (FIGS. 1 and 1*a*) is provided in the passage 13 in the handle 10. It comprises a fixed pivot 31 which is disposed in the handle 10 and which extends across the passage 13 and on which a two-armed rocking lever 32 is pivotally mounted. Each end of the lever 32 has a tongue 33, 33' respectively, only one of which ever extends into the passage 13 through an opening 13'. A tension spring 34 holds the lever 32 in the inoperative position shown in FIG. 1. Lever 32 is connected by a piece of wire 35 formed with eyes, to a slide 36 mounted for longitudinal displacement in a guide groove 38 recessed in the handle 10. A contact part 36' of the slide 36 extends to the outside of the handle 10 at the top, through a slot 39 extending from the guide groove 38.

When the nail retainer is actuated, i.e. when the slide 36 is pulled manually to the rear and then released for forward movement by spring 34 , nail retainer 30 releases the nail $N_1$ for movement into and through deflector 14 and then retains the next subsequent nail $N_2$ in its inoperative position (FIG. 1). Once the nail $N_1$ has been inserted into the workpiece (FIG. 3), the tool and the hammer head are again held as shown in FIG. 2 and the slide 36 is moved rearwardly by means of the thumb in the direction of the arrow x (FIG. 1). The front tongue 33 thus lifts to release the nail $N_2$ while the rear tongue 33' retains the next nail $N_3$ situated behind it. The tension spring 34 is tensioned when the slide 36 is moved rearwardly and when the latter is released the lever 32 pivots in the clockwise direction, the nail $N_3$ passing into the position previously occupied by the nail $N_2$.

FIG. 2 shows the position that the tool has to be brought into for a nail to pass to the position of readiness for insertion into the workpiece.

FIG. 3 shows the setting operation and FIG. 4 shows the set nail being knocked home.

Figure 1:
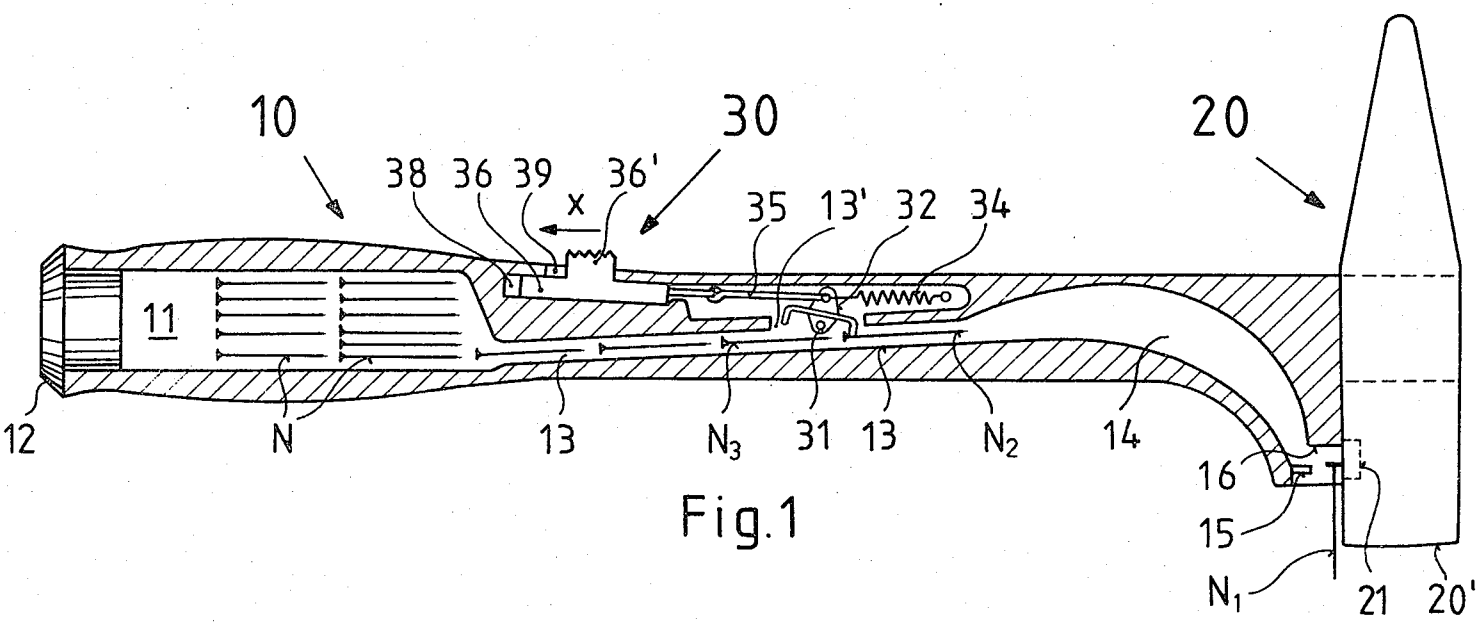
Figure 1A:
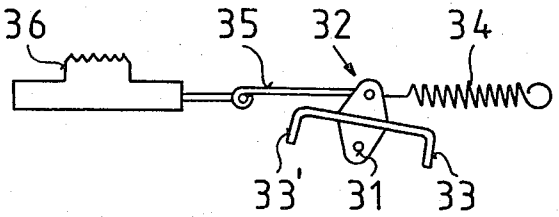
Figure 4:
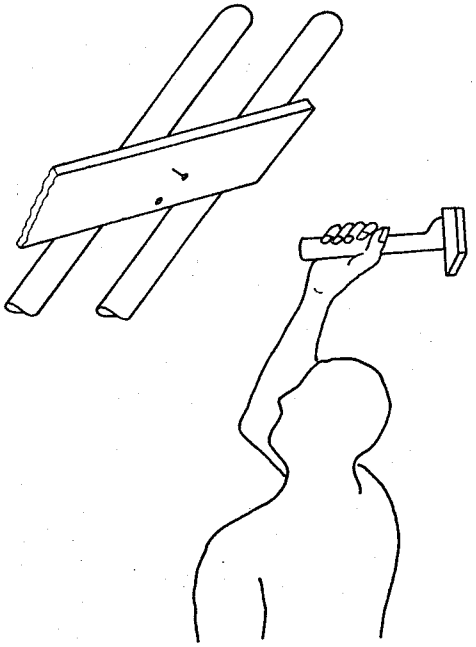
FIGS. 2, 3 and 4 show the successive operations during use of the tool.
Figure 3:
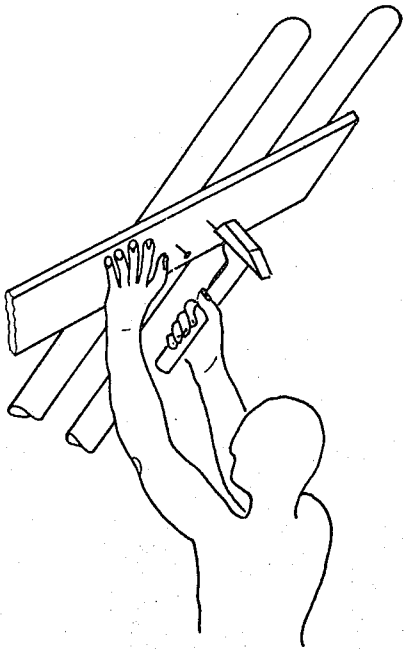
Figure 2:
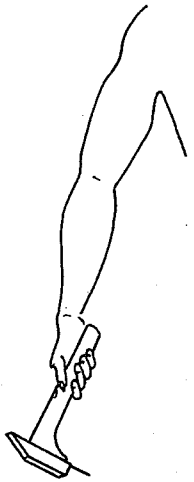

For correct operation the nails N must of course be introduced into the cavity 11 with their points pointing towards the hammer head 20.

I claim:

1. A magazine hammer comprising an elongated handle having a head fixedly attached to one end of said handle, an elongated guide passage disposed entirely within said handle, said guide passage including a first portion extending in the direction of elongation of said handle toward said head and a second portion which is adapted to reorient nails which have passed through the first portion of said guide passage, a supply of nails in communication with said guide passage, means for feeding nails from said supply through said guide passage toward said head, and a setting device located adjacent the downstream end of said second portion of said guide passage for use in setting a nail into a workpiece preliminary to its being driven into said workpiece by the head of said hammer; said supply comprising a cavity disposed entirely within said handle at the end of said handle remote from said head, said cavity being dimensioned to retain a plurality of nails therein which are oriented respectively in the direction of elongation of said handle and with the heads of said nails facing toward said remote end of said handle, said first portion of said guide passage communicating with said cavity and being dimensioned to admit only one nail at a time, in the direction of elongation of said nail, from said supply for passage under the influence of gravity toward said second portion of said guide passage; said feeding means comprising a member pivotally mounted within said handle adjacent said first portion of said guide passage and carrying thereon a pair of tongues which are spaced from one another in the direction of elongation of said handle, said tongues each extending toward said guide passage and being arranged so that one or the other of said tongues extends into and across said first portion of said guide passage in dependence upon the pivotal position of said member whereby, when the downstream one of said tongues extends across said first portion of said guide passage the movement of nails toward said second portion of said guide passage is blocked, and subsequent variation in the pivotal position of said member operates to displace the downstream one of said tonges out of said first portion of said guide passage to permit movement under the influence of gravity of a single nail past said downstream tongue toward said second portion of said guide passage while the upstream one of said tongues is simultaneously displaced into said first portion of said guide passage to block movement of a next subsequent nail toward said second portion of said guide passage; said second portion of said guide passage comprising a curved cavity the upstream end of which communicates with the downstream end of said first portion of said guide passage, the downstream end of said curved cavity being open at a position adjacent to but rearward of the striking face of said head; said setting device comprising an auxiliary striking surface extending generally parallel to but rearward of and laterally displaced from the striking face of said head at a position adjacent to and laterally displaced from the downstream open end of said curved cavity, and a permanent magnet mounted in fixed stationary position relative to said handle and head adjacent said auxiliary striking surface and operative to laterally displace each nail after it has emerged under the influence of gravity from the downstream open end of said curved cavity into a position wherein the head of said nail is disposed in directly facing relation to said auxiliary striking surface.

2. The hammer of claim 1 wherein the curved cavity comprising said second portion of said guide passage varies in cross section longitudinally but has a substantially constant lateral width that is substantially equal to the width of the said first portion of said guide passage.

3. The hammer of claim 2 wherein said first portion of said guide passage has a circular cross section sized to allow the head of a nail to pass therethrough with clearance.

4. The hammer of claim 1 wherein said setting device further comprises a fork-shaped element disposed adjacent the downstream open end of said curved cavity for catching the head of a nail which has emerged from said downstream open end.

5. The hammer of claim 4 wherein said permanent magnet is fixedly mounted on the head of said hammer at a position opposite to and spaced from said fork-shaped element, said auxiliary striking surface being located between said fork-shaped element and said permanent magnet at a position rearward of each, whereby said magnet operates to lift each nail caught by said fork-shaped element laterally out of said element toward the head of said hammer and into a setting position adjacent said auxiliary striking surface.

6. The hammer of claim 1 wherein said auxiliary striking surface is an integral part of the handle of said hammer.

7. The hammer of claim 1 wherein said auxiliary striking surface is an integral part of the head of said hammer.

* * * * *